US005839380A

United States Patent [19]

Muto

[11] Patent Number: 5,839,380

[45] Date of Patent: Nov. 24, 1998

[54] METHOD AND APPARATUS FOR PROCESSING EMBROIDERY DATA

[75] Inventor: Yukiyoshi Muto, Nagoya, Japan

[73] Assignee: Brother Kogyo Kabushiki Kaisha, Nagoya, Japan

[21] Appl. No.: 991,873

[22] Filed: Dec. 17, 1997

[30] Foreign Application Priority Data

Dec. 27, 1996 [JP] Japan ..... 8-350275

[51] Int. Cl.[6] ..... D05B 21/00; D05C 9/06

[52] U.S. Cl. ..... 112/102.5; 112/475.19; 364/470.09

[58] Field of Search ..... 112/102.5, 470.04, 112/454, 456, 458, 470.06, 475.19; 364/470.09

[56] References Cited

U.S. PATENT DOCUMENTS 5,558,031 9/1996 Muto et al. ..... 112/102.5
5,559,711 9/1996 Futamura ..... 112/102.5 X
5,563,795 10/1996 Futamura et al. .
5,740,057 4/1998 Futamura ..... 112/102.5

FOREIGN PATENT DOCUMENTS 7-136361 5/1995 Japan .
8-44848 2/1996 Japan .

*Primary Examiner*—Peter Nerbun
*Attorney, Agent, or Firm*—Oliff & Berridge, PLC

[57] ABSTRACT

Disclosed is a method and an apparatus for creating a sewing data, based on image data representing an embroidery pattern, to be used for forming the embroidery pattern. A connected area consisting of a set of connected black pixels of the image data is divided into a plurality of divided connected areas, and a type of stitch is assigned to each of the divided connected areas. A data creating system creates sewing data for each of the divided connected areas. When the sewing data is created, different algorithms are used depending on the type of stitch assigned to the processed area.

13 Claims, 11 Drawing Sheets

METHOD AND APPARATUS FOR PROCESSING EMBROIDERY DATA

BACKGROUND OF THE INVENTION

The present invention relates to a method and apparatus for processing an embroidery data which is used for forming embroidery patterns on a workpiece based on an image data of the patterns to be embroidered.

Conventionally, in a field of industrial sewing machines, an embroidery data creating device with which the embroidery data can be created based on a desired original showing an embroidery pattern has been provided. Such an embroidery data creating device is generally provided with a general-use personal computer, an image scanner, a hard disk drive, a keyboard, a CRT (cathode ray tube) display, and the like.

In the embroidery data creating device, the original pattern, which may be printed or drawn by hand, is scanned by the image scanner to obtain an image data thereof. Then, connected areas consisting of connected pixels are extracted from the image data. For each connected area, an outline and/or a center line data is obtained, and then, an embroidery data for each connected area is created based on the outline data and/or the central line data.

When the embroidery data is created in accordance with the above-described procedure, if a connected area is an elongated area, the central line data of the elongated area is obtained, and a zigzag stitch or a running stitch is assigned to the area with reference to the central line. Thus, the connected area can be sewn with preferable stitches. If a connected area is not an elongated area, an outline data of the connected area is obtained, and the embroidery data is created such that an area defined by the outline is filled with satin stitches or Tatami stitches. Thus, also in this case, preferable stitches can be obtained.

FIG. 11A shown an example of a connected area which includes a first area A and a second area B. In this example, the area B is regarded as the elongated area, and the area A is not regarded as the elongated area. If one of the above-described methods is applied to create the sewing data for the connected area shown in FIG. 11A, a problem as indicated below arises.

That is, if a method using an outline is applied to the entire shape of the connected area shown in FIG. 11A, two outlines L1 and L2 are obtained as shown in FIG. 11B. Then, the area defined between the outlines L1 and L2 is filled by stitches. In this example, since a direction in which the stitches extend is between the lower-left and upper-right, at a portion in the area B indicated by arrow X, a direction of the stitches and a direction in which the connected area extends substantially coincide with each other, and therefore the portion cannot be sewn appropriately as shown in FIG. 11C. If a method using the central line is applied to the entire shape of the connected area shown in FIG. 11A, the area B would be sewn appropriately, and the area A would not be sewn appropriately, i.e., the sewn area A may be different from the original shape of the area A shown in FIG. 11A.

SUMMARY OF THE INVENTION

It is therefore an object of the invention to provide an improved method and apparatus for processing an embroidery data to obtain an appropriate embroidery sewing data corresponding to a connected area regardless of the shape thereof.

For the object, according to an aspect of the invention, there is provided a method for creating sewing data, based on image data representing an embroidery pattern, to be used for forming the embroidery pattern, the method comprising the steps of: dividing a connected area consisting of a set of connected pixels of the image data into a plurality of divided connected areas; assigning a type of stitch to each of the divided connected areas; and creating a sewing data for each of the divided connected areas, different algorithms being used for creating the sewing data depending on the type of stitch assigned to the divided connected areas, respectively.

Thus, the operator can divide the connected area at any position, and further assign a type of stitch to each of the divided areas.

Optionally, if the type of stitches is a first predetermined stitch, the step of creating extracts an outline of the divided connected area, and creates stitch points for filling the outline, the sewing data including data of the stitch points.

Further optionally, if the type of stitches is a second predetermined stitch, the step of creating applies a thinning algorithm to the divided connected area to extract a central line of the divided connected area, and creates stitch points in relation with the central line, the sewing data including data of the stitch points.

It should be noted that the first predetermined stitch may be a satin stitch, Tatami stitch or the like. Further, the second predetermined stitch may be a zigzag stitch, a running stitch or the like.

According to another aspect of the invention, there is provided an embroidery data processing apparatus for creating a sewing data, based on an image data representing an embroidery pattern, to be used for forming the embroidery pattern, the apparatus comprising: an area dividing system, which divides a connected area consisting of a set of connected pixels of the image data into a plurality of divided connected areas; a stitch type assigning system, which assigns a type of stitch to each of the divided connected areas divided by the area dividing system; and a data creating system, which creates a sewing data for each of the divided connected areas, different algorithms being used for creating the sewing data depending on the type of stitch assigned by the stitch type assigning system.

Optionally, the area dividing system comprises: a display, the embroidery pattern being displayed on the display; and an operable member to be operated by an operator to designate positions on the display at which the embroidery pattern is to be divided.

In this case, boundary lines may be displayed on the display as the operable member is operated and the positions at which the embroidery pattern is to be divided is designated by the boundary lines.

Further optionally, if the type of stitch is a first predetermined stitch, the data creating system extracts an outline of the divided connected area, and creates stitch points for filling the outline, the sewing data including data of the stitch points.

In this case, the first predetermined stitch may be a satin stitch, Tatami stitch or the like.

Optionally, if the type of stitch is a second predetermined stitch, the data creating system applies a thinning algorithm to the divided connected area to extract a central line of the divided connected area, and creates stitch points in relation to the central line, the sewing data including data of the stitch points. In this case, the second predetermined stitch may be a zigzag stitch, a running stitch or the like.

BRIEF DESCRIPTION OF THE ACCOMPANYING DRAWINGS

Figure 8A:
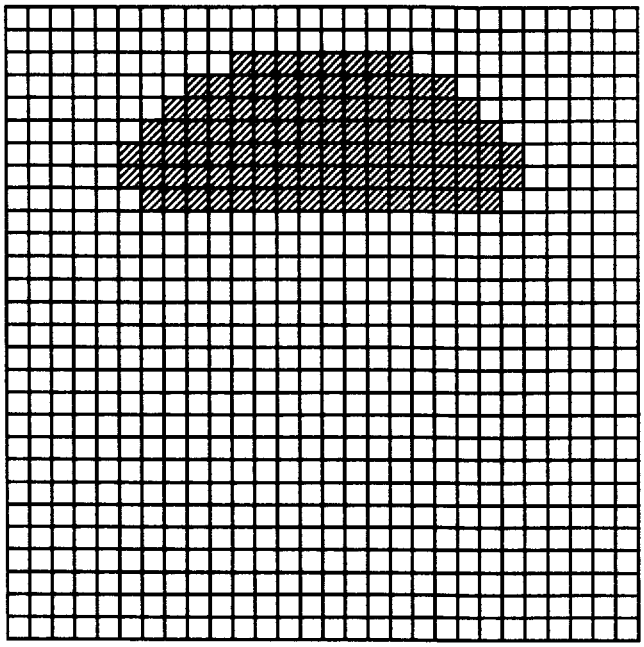
Figure 8B:
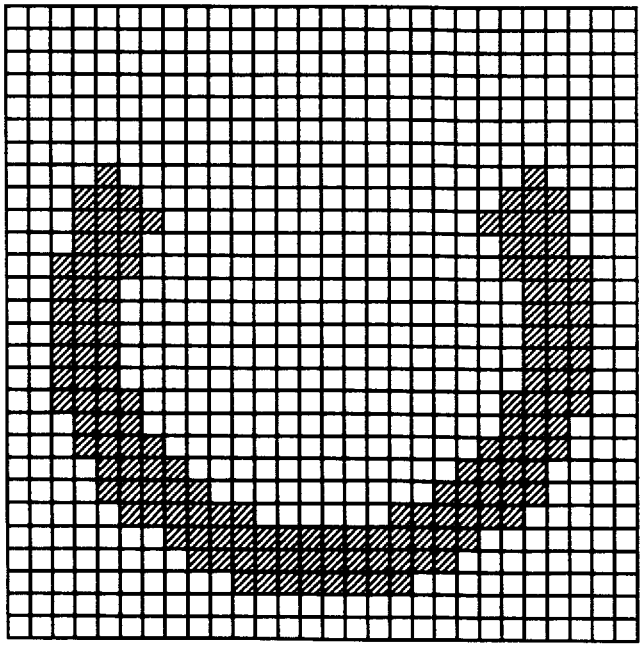
Figure 9A:
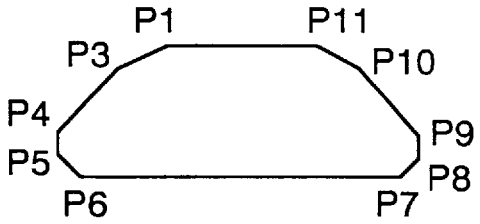
Figure 9B:
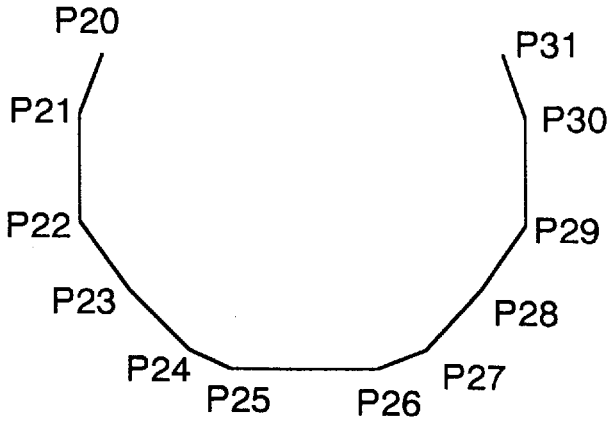
Figure 10:
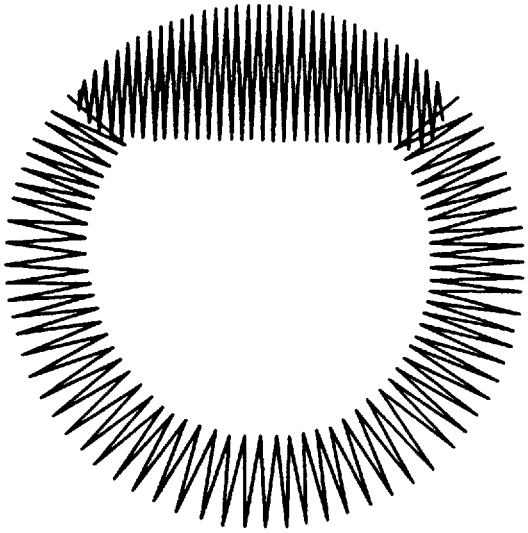

FIGS. 8A and 8B respectively show divided image data divided at the border lines;

FIGS. 9A and 9B show vector data corresponding to the divided image data shown in FIGS. 8A and 8B, respectively;

FIG. 10 shows an example of sewn pattern; and

Figure 11A:
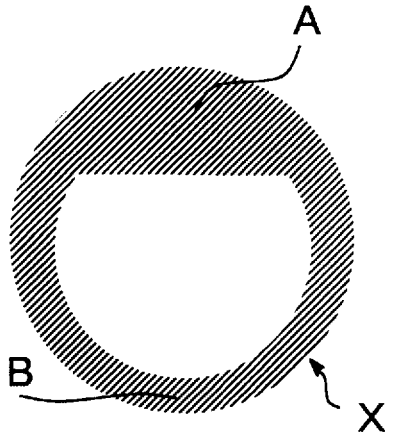
Figure 11B:
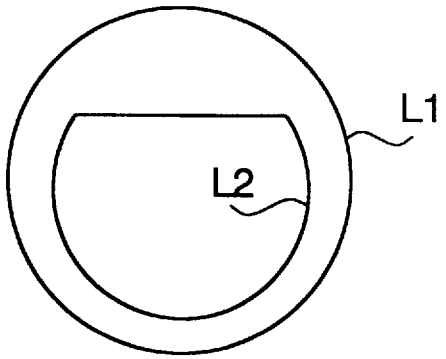
Figure 11C:
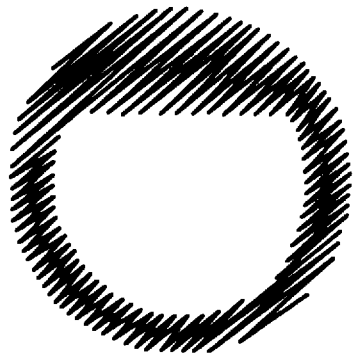
FIG. 11C PRIOR ART

FIGS. 11A through 11C show a sewing data creating process when a conventional method is applied.

DESCRIPTION OF THE EMBODIMENTS

An embroidery data processing apparatus according to an embodiment of the present invention will be described with reference to the accompanying drawings.

In the embodiment, an embroidery pattern is scanned with an image scanner to create image data. Then, based on the image data, connected areas respectively consisting of connected pixels, each having a density value 1, are extracted. Based on shape data obtained from the connected areas and types of stitches (e.g., a zigzag stitch, a running stitch and the like) assigned to the connected areas, sewing data for respective connected areas is created, and stored in a recording medium such as a flash memory card. The flash memory card may be inserted in a home-use sewing machine, and the embroidery pattern is formed on a work cloth.

Figure 1:
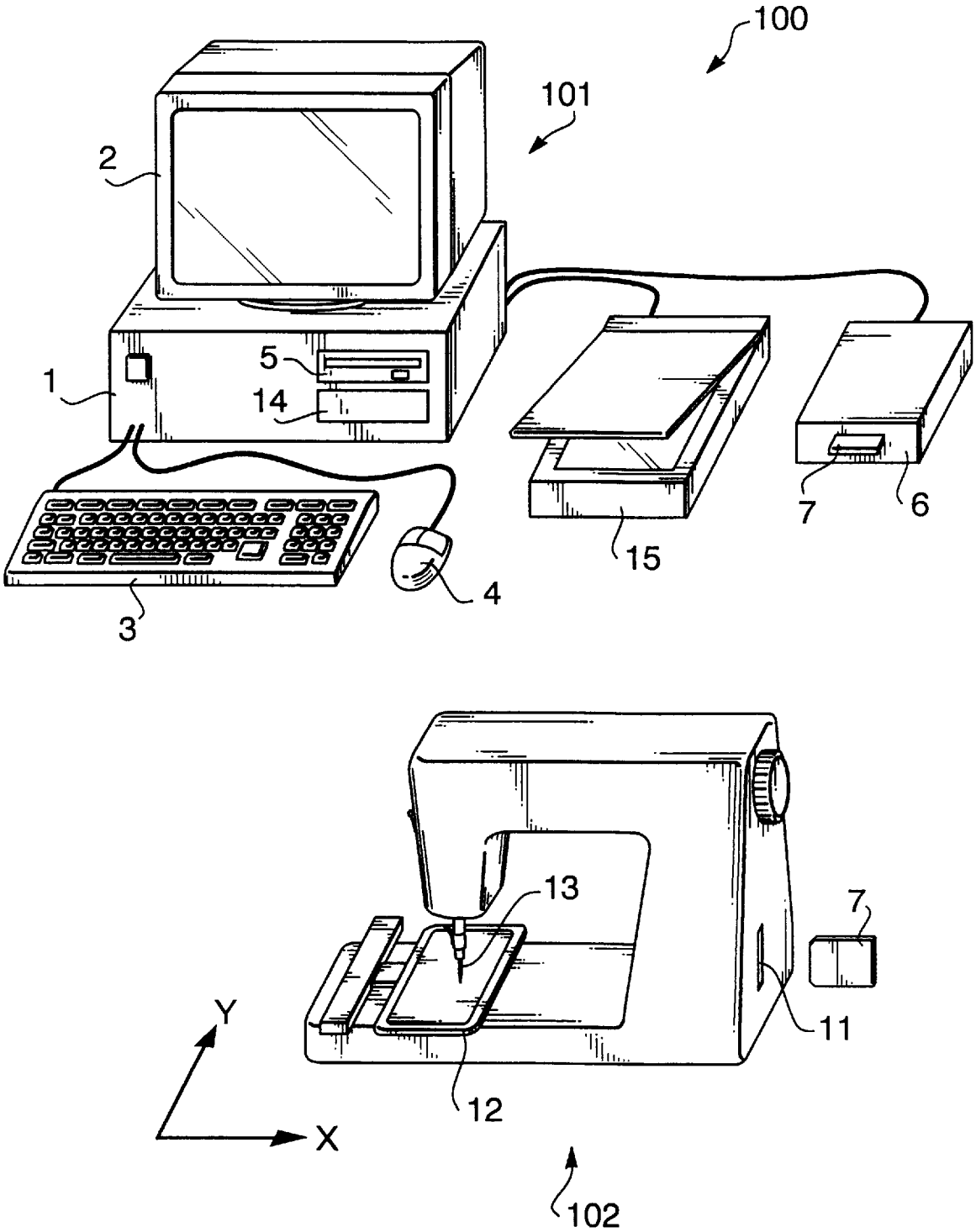
FIG. 1 is a schematic perspective view of an embroidery sewing system including an embroidery data processing apparatus and an embroidery sewing machine.

FIG. 1 is a schematic perspective view of an embroidery sewing system 100 including an embroidery data processing apparatus 101 and an embroidery sewing machine 102. The embroidery data processing apparatus 101 includes a CRT display 2 for displaying image and characters, a keyboard 3 and a mouse 4 for designating points on a displayed image and/or select a menu, a floppy disk device 5 and a hard disk device 14 storing image data and/or embroidery data, a flash memory device 6 for storing the embroidery data in a detachable memory card 7 having a non-volatile flash memory, an image scanner 15 for capturing an original pattern, and a controlling unit 1 to which the above are connected.

The sewing machine 102 has a embroidery frame 12 which is mounted on a machine bed. A work cloth is held by the frame 12 which is moved in X and Y directions indicated in FIG. 1 by a horizontal movement mechanism (not shown). A sewing needle 13 and a rotating hook mechanism (not shown) are reciprocally driven as the frame 12 is moved based on the embroidery data to form the embroidery pattern on the cloth held by the frame 12.

It should be noted that the embroidery sewing machine 102 is provided with a controller including a microcomputer, which controls the horizontal moving mechanism, a needle bar and the like at every stitch cycle so that embroidering operation can be performed automatically. As shown in FIG. 1, the sewing machine 102 is further provided with a flash memory device 11 to which the memory card 7 storing the embroidery data can be inserted.

The embroidery data processing apparatus 101 creates the embroidery data to be used by the sewing machine 103.

Figure 2:
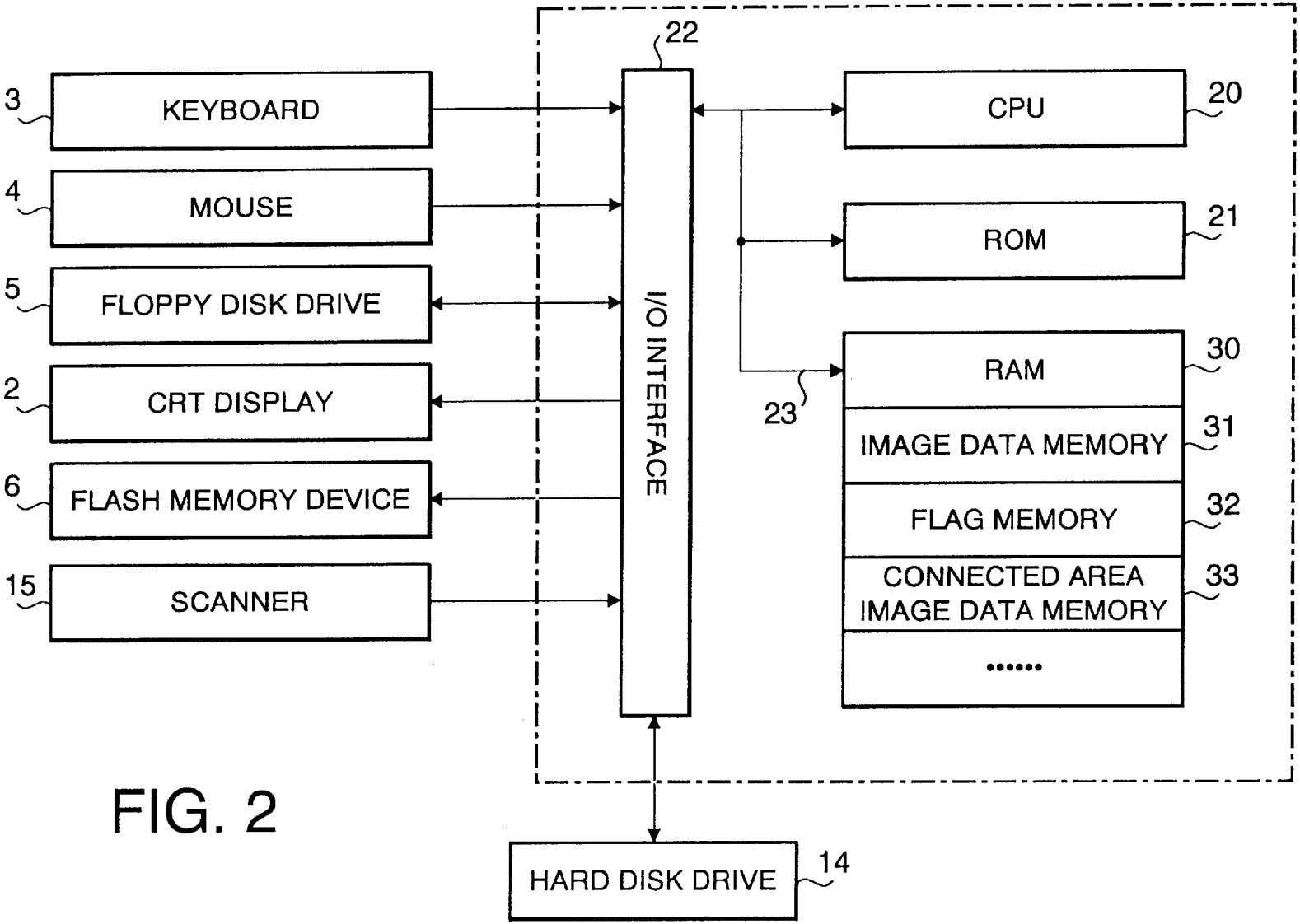
FIG. 2 is a block diagram illustrating a control system of the embroidery data processing apparatus.

FIG. 2 is a block diagram illustrating a control system of the embroidery data processing apparatus 101.

The control unit 1 accommodates a controlling device CD. The controlling device CD includes a CPU (Central Processing Unit) 20 which is connected with an input/output (I/O) interface 22 through a bus 23 having a data bus and the like. The controlling device CD further includes a ROM (Read Only memory) 21, and a RAM (Random Access Memory) 30. In the ROM 21, control programs to be executed by the CPU 20 to create the embroidery data is stored.

The RAM 30 includes an image data memory 31, an image data control flag memory 32, and a connected area image data memory 33. The image data memory 31 stores image data having a density value 1 or 0, which is obtained with the image scanner 15. The density value 1 represents a black pixel, and the density value 0 represents a white pixel. The image data control flag memory 32 stores an examination flag and a boundary flag for each pixel of the image data memory 31. The connected area image data memory 33 stores image data of each of divided connected areas. The examination flag is for storing a process history, i.e., whether the, corresponding pixel has been examined in a connected area extracting process which will be described later. The boundary flag is set to 1 when the corresponding pixel is included in boundary lines, which will also be described later.

The embroidery data creating process executed by the controlling device CD will now be described with reference to flowcharts shown in FIGS. 3 and 4.

Figure 3:
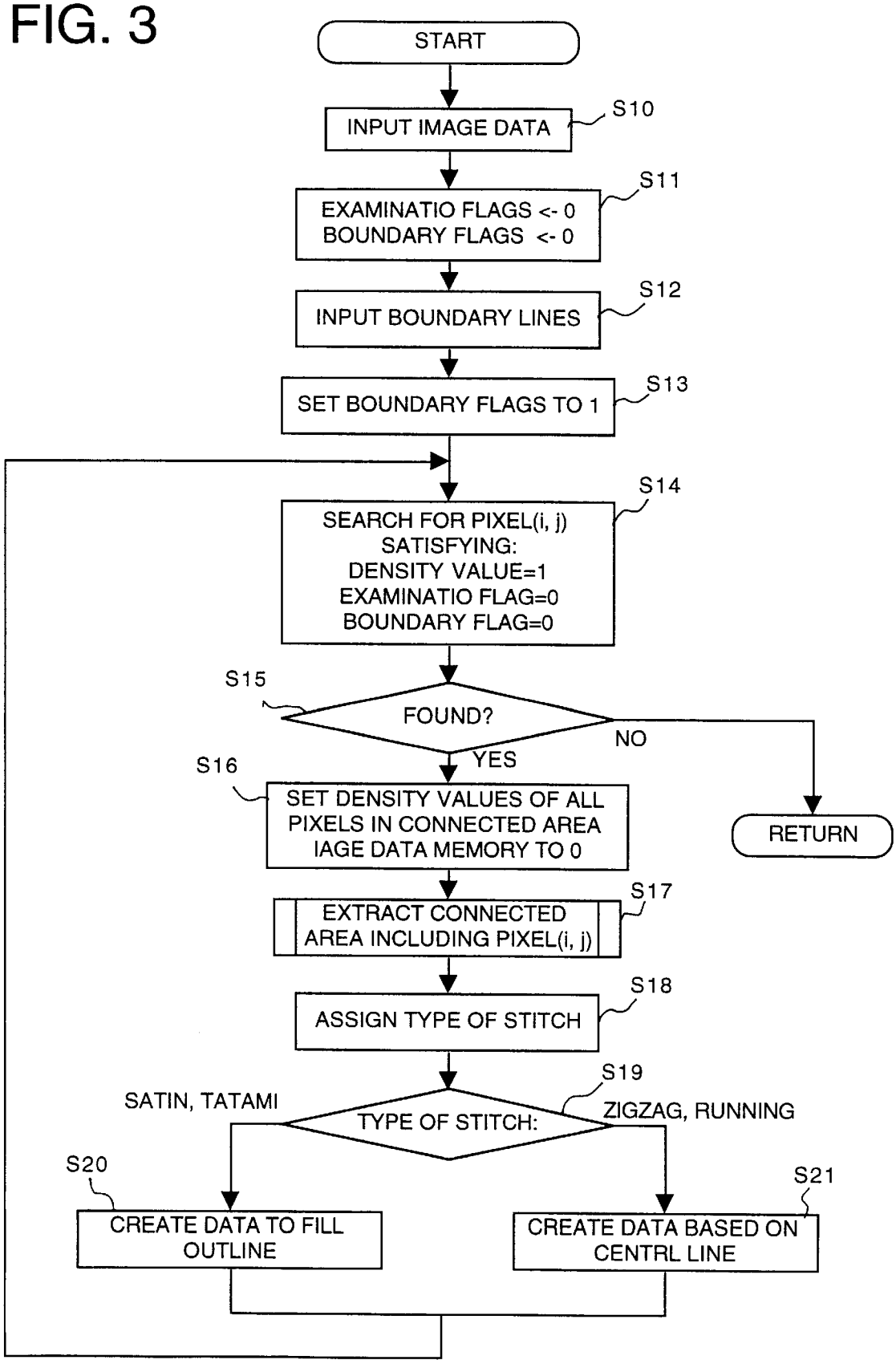
FIG. 3 is a flowchart illustrating an embroidery data creating process.

FIG. 3 is a flowchart illustrating a main process for creating the embroidery data.

When the keyboard 3 is operated to start creating the embroidery data, the process shown in FIG. 3 is executed.

Figure 5:
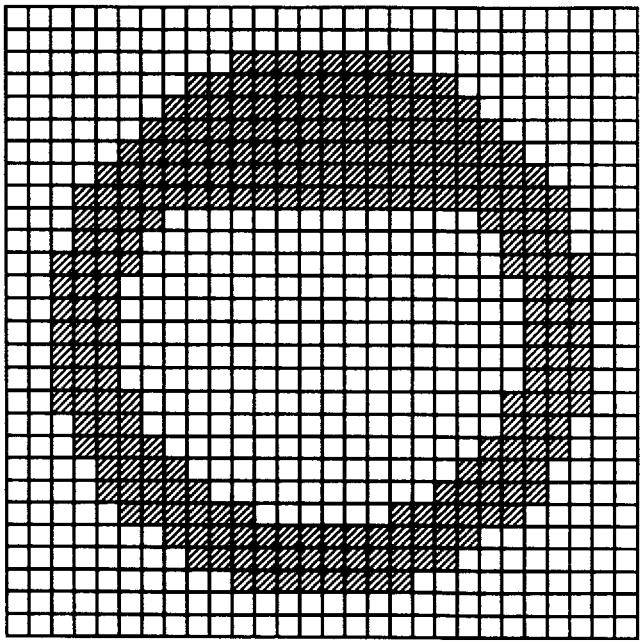
FIG. 5 is a chart showing an image data of a pattern.

At S10, an original image is scanned by the image scanner 15 and an image data is obtained. The image data is stored in the image data memory 31 as a raster type bit map data. Specifically, each pixel of the image data (i.e., the bit map data) has a density value 0 representing a white pixel or a value 1 representing a black pixel. FIG. 5 schematically shows an example of the image data, wherein one box represents one pixel and hatched boxes correspond to the black pixels (i.e., density value=1) and blank (white) boxes correspond to the white pixels (i.e., density value=0).

S11, the examination flags and boundary flags corresponding to all the pixels in the image data memory are set to zero.

At S12, the image data stored in the image data memory 31 is retrieved and displayed on the CRT display 2, on which boundary lines are to be input by an operator by means of the mouse 4 or the like. It should be noted that, in this embodiment, the operator can input the boundary lines if the connected area includes elongated portions (like the area B in FIG. 11A) which are to be embroidered with respect to the central line thereof so that such portions are divided from the connected area. The remainder will be embroidered based on an outline to be filled with satin or Tatami stitches.

Figure 6:
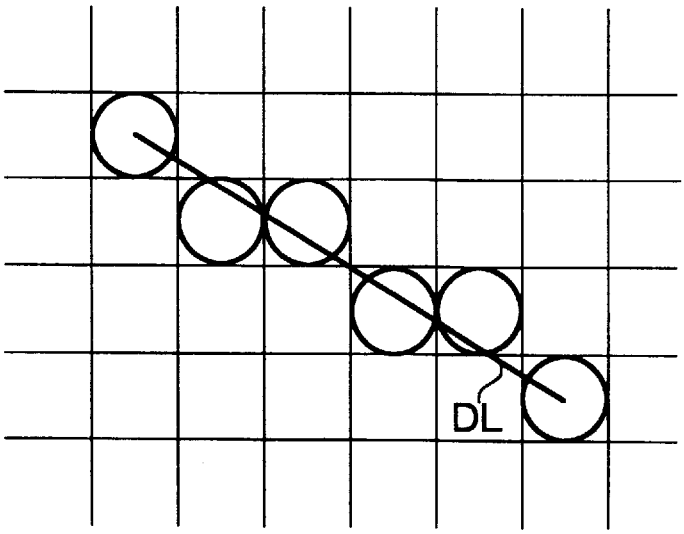
FIG. 6 is a chart showing pixels around a border line.

At S13, the boundary flags corresponding to the input boundary lines are set to 1. Note that the setting of the boundary flags is executed in accordance with a straight line generating algorithm which is well known in the field of raster graphics. As a result of the flag setting procedure at S13, the boundary flags corresponding to the boundary lines DL are set to 1 as shown in FIG. 6. In FIG. 6, one box represents one flag corresponding to one pixel, and boxes in which circles are indicated represent boundary flags having value 1.

Figure 7A:
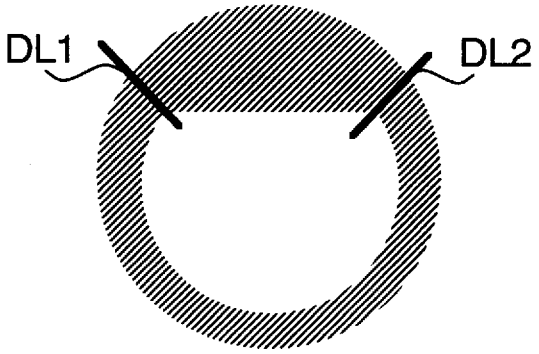
FIGS. 7A and 7B show the image data with the border lines being inserted.
Figure 7B:
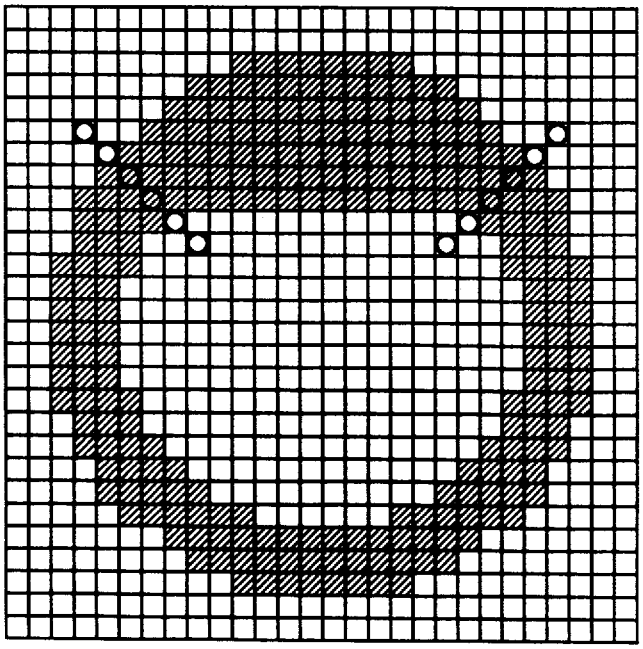

FIG. 7A shows a screen image of the CRT display 2 when the boundary lines DL1 and DL2 are input by the operator. FIG. 7B shows a relationship between the image pixels and boundary flags. One box corresponds to one pixel and one flag, and boxes in which circles are indicated corresponds to the boundary flags set to 1 at S13.

The image data, the boundary flags and the examination flags are scanned from left to right, and up to bottom to search pixels (i, j), which represent black pixels, corresponding examination flags are set to zero (i.e., which are not yet examined), and which are not on the boundary lines (i.e., the boundary flags corresponding thereto are set to zero) at S14. Note that a pixel (i, j) is an i-th from the left and j-th from the top in the bit map arrangement.

If a pixel (i, j) satisfying the above condition is found (S15:YES), all the pixels of the connected area image data memory 33, to which the connected area including the pixel (i, j) is copied, are set to zero so that all the pixels represent white pixels at S16. Then, a connected area extracting process is executed at S17 for extracting a connected area including the pixel (i, j).

Figure 4A:
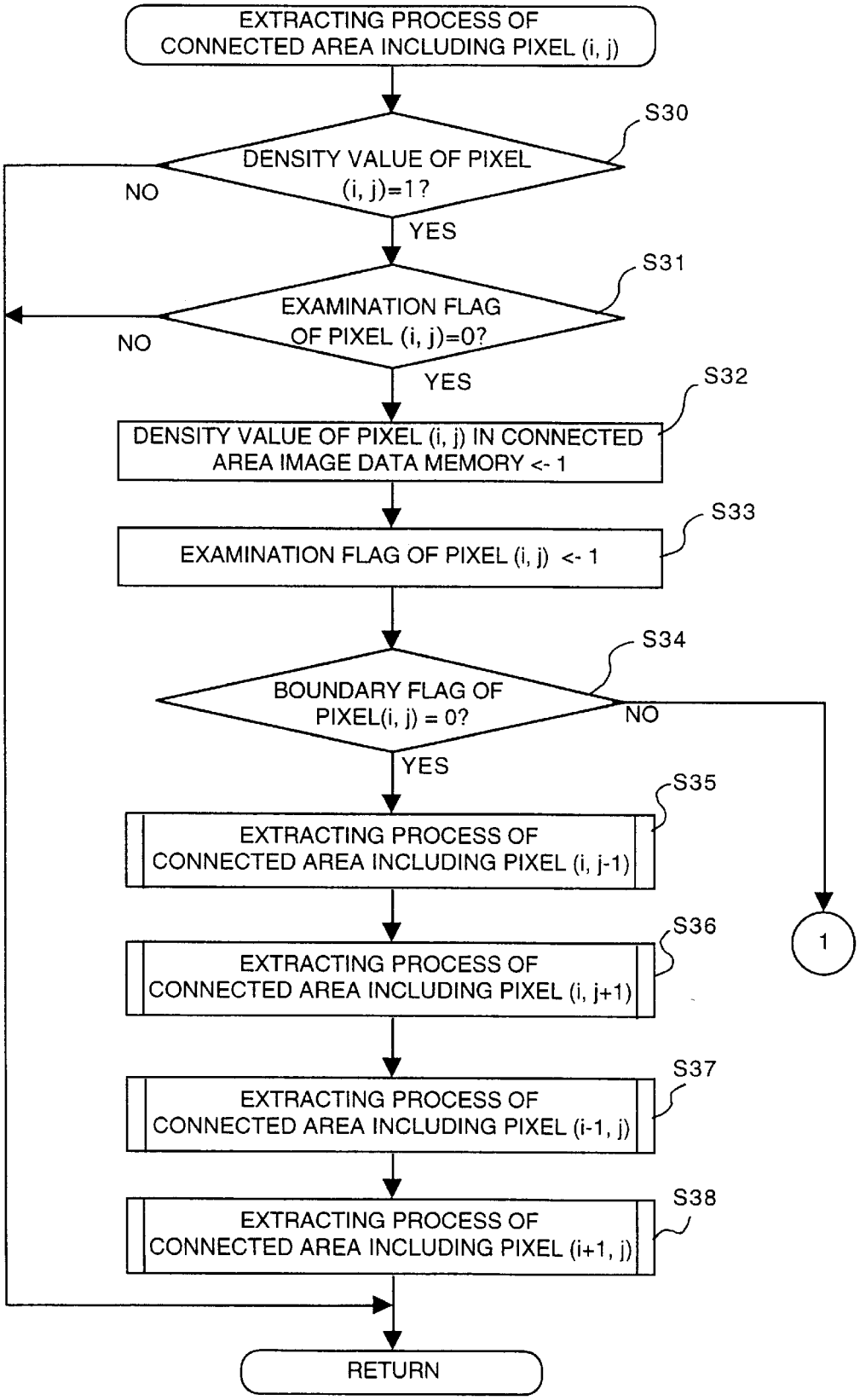
FIGS. 4A and 4B show a flowchart illustrating a connected area extracting process.
Figure 4B:
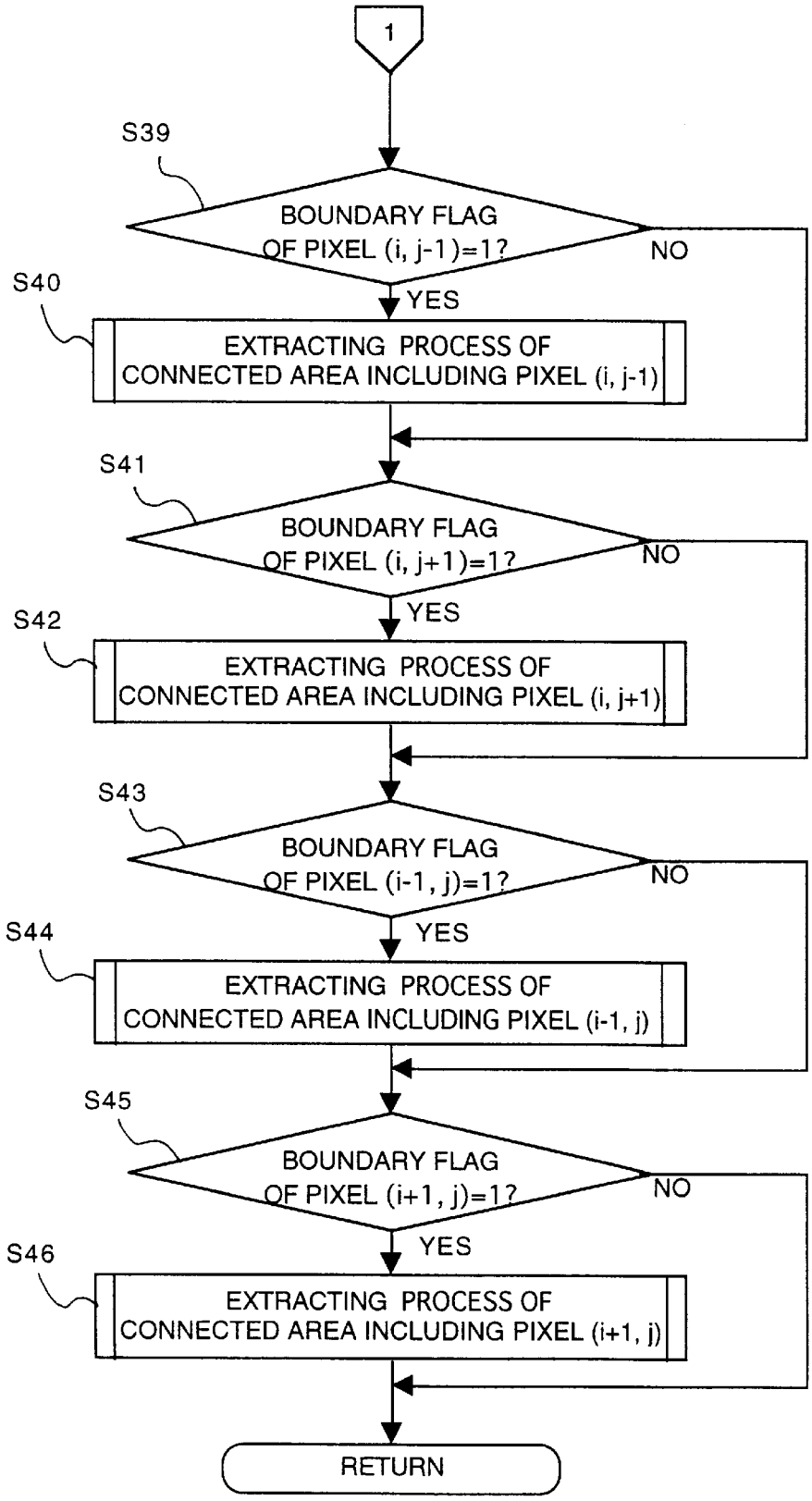

FIG. 4 is a flowchart illustrating the connected area extracting process. When the connected area extracting process is executed, it is determined whether the density value of the pixel (i, j) is 1 (i.e., black), at S30. If the density value of the pixel (i, j) is 1 (S30:YES), it is determined whether the examination flag for the pixel (i, j) is 0 (i.e., not examined) at S31. If the pixel (i, j) has not yet been examined (i.e., the examination flag is 0) (S31:YES), a density value of the pixel (i, j) in the connected area image data memory 33 is set to 1 (S32), and then the examination flag for the pixel (i, j) is set to 1 (at S33).

At S34, it is determined whether the boundary flag for the pixel (i, j) is set to 0. If the boundary flag for the pixel (i, j) is set to 0 (S34:YES), for each of four adjacent pixels, i.e., a pixel (i, j−1), a pixel (i, j+1), a pixel (i−1, j), and a pixel (i+1, j), the connected area extracting process for extracting the connected area including respective one of the above pixels is executed (S35, S36, S37 and S38). The above is a recursion of the connected area extracting process for the connected area including the pixel (i, j).

If the boundary flag for the pixel (i, j) is set to 1 (S34:NO), it is determined, for each of four adjacent pixels, a pixel (i, j−1), a pixel (i, j+1), a pixel (i−1, j) and a pixel (i+1, j), whether the boundary flag is set to 1 (S39, S41, S43 and S45). If the boundary flag is set to 1 (S39:YES;. S41:YES; S43:YES; and/or S45:YES), the connected area extracting process for extracting a connected area including each of the above pixels is executed. Note that this is also the recursion of the connected area extracting process for extracting the connected area including the pixel (i, j). For the procedure at S39 through S46, even if a pixel (i, j) is a pixel whose density value is 1 and located on a boundary line, the pixel is included in the connected area stored in the connected area image data memory 33.

By the above-described recurrent execution of the connected area extracting process, a connected area including the pixel (i, j) and not exceeding the boundary line is extracted and stored in the connected area image data memory 33. For example, from the image data shown in FIG. 7B in which the boundary flags are set, at the first execution of the process at S17 in FIG. 3, the connected area as shown in FIG. 8A is extracted, and at a second execution of the process at S17, the connected area shown in FIG. 8B will be extracted.

In the connected area extracting process shown in FIG. 4, four adjacent pixels are examined. However, the embodiment may be modified to examine eight adjacent pixels. In such a case, with respect to the pixel (i, j), four more pixels, a pixel (i−1, j−1) , a pixel (i−1, j+1) , a pixel (i+1, j−1) and a pixel (i+1, j+1), which should not exceed the boundary line, are to be examined.

To the connected area thus extracted and stored in the connected area image data memory 33, a type of stitch is assigned at S18. In this embodiment, the operator assigns a type of the stitch which is appropriate for the connected area thus divided. For example, to the connected area shown in FIG. 8A, a Tatami stitch may be assigned, and to the connected area shown in FIG. 8B, a zigzag stitch may be assigned.

At S19, based on the type of the stitch assigned to the connected area, the process diverges. Specifically, if the type of the stitch is the satin stitch or Tatami stitch, control proceeds to S20 since such a type of stitch is appropriate for filling an outlined area. If the type of the stitch is the zigzag stitch or the running stitch, control proceeds to S21 since such a type of stitch is appropriate for sewing with respect to a central line of the area.

At S20, the sewing data is created based on the outline of the connected area. Therefore, the outline of the area is extracted first. In order to extract the outline, a well-known boundary tracing algorithm is applied. Since the algorithm is well known in the art, and is not essential for the present invention, description thereof will be omitted. It should be noted that as a result of the outline extracting process, an outline consisting of a closed chain of pixels having width of 1 dot is extracted.

Then, the chain of pixels is vectorized to obtain a vectorized outline data consisting of a set of lines having appropriate lengths and directions. It should be noted that various methods for vectorization are known. An example of vectorization method is as follows. A starting point is determined, and with following the closed chain, pixels are examined at a certain interval to obtain significant points, and then based on the significant points, the vector data is created.

For example, from the connected area shown in FIG. 8A, an outline shown in FIG. 9A is extracted.

Based on the extracted outline as shown in FIG. 9A, and the type of the stitch assigned to the connected area at S18, stitching points are generated inside the outline. Note that, for developing stitching points in an outlined area, a method in which the outlined area is divided into embroidery blocks consisting of four points has been known.

At S21, an embroidery data in relation to the central line of the connected area is created. In order to obtain the central line, a thinning operation is applied to the connected area. The pixels located at edge sides of the connected area are deleted in order, in accordance with a predetermined rule, until no further pixels can be deleted. The rule for deleting pixels will not be describe in detail herein, various algorithm have been developed and used. If the width of the central line is 1 dot, any one of known thinning methods can be applied.

The line image data obtained as a result of the thinning operation is converted into a set of successively connected line segments each having an appropriate length and direction by a vectorizing operation. The vectorizing operation is similar to that used when the outline data is vectorized. For example, from the connected area shown in FIG. 8B, successively connected line segments as shown in FIG. 9B are extracted.

Then, based on the extracted line segments and the type of stitch assigned to the connected area, the embroidery sewing data using the extracted line segments as a central line is generated.

When the process at S20 or S21 is finished, control proceeds to S14 where it is determined whether another connected area remains. If there remains another connected area (S15:YES), procedure of S16–S21 is repeated. If there are no connected areas to be processed (S15:NO), the connected area extracting process is terminated.

FIG. 10 shows an example of sewn pattern which is formed in accordance with the embroidery data created in the above-described embodiment.

In the embodiment described above, the type of the stitch is assigned to the connected areas by the operator. The embodiment can be modified such that the type of the stitch is automatically determined. By applying a distance transformation with respect to each connected area to obtain distance values, and statistically evaluating the distance values, it may be possible to determine the type of stitch to be applied to the connected area. Such a method is disclosed in Japanese Patent Provisional Publication No. HEI 7-136361. If the type of the stitch is determined automatically, only by inputting boundary lines for dividing the connected area, the embroidery data for the entire embroidery pattern can be generated.

Instead of setting the boundary flags in accordance with the input boundary lines, by setting the density values of the pixels corresponding to the input boundary lines to 0, it is also possible to extract divided connected areas separately.

The present disclosure relates to subject matter contained in Japanese Patent Application No. HEI 08-350275, filed on Dec. 27, 1996, which is expressly incorporated herein by reference in its entirety.

What is claimed is:

1. A method for creating a sewing data, based on image data representing an embroidery pattern, to be used for forming said embroidery pattern, said method comprising the steps of:

dividing a connected area consisting of a set of connected pixels of said image data into a plurality of divided connected areas;

assigning a type of stitch to each of said divided connected areas; and creating sewing data for each of said divided connected areas, different algorithms being used for creating said sewing data depending on said type of stitch assigned to said divided connected areas, respectively.

2. The method according to claim 1, wherein if said type of stitches is a first predetermined stitch, said step of creating extracts an outline of said divided connected area, and creates stitch points for filling said outline, said sewing data including data of said stitch points.

3. The method according to claim 2, wherein if said type of stitches is a second predetermined stitch, said step of creating applies a thinning algorithm to said divided connected area to extract a central line of said divided connected area, and creates stitch points in relation with said central line, said sewing data including data of said stitch points.

4. The method according to claim 2, wherein said first predetermined stitch comprises one of a satin stitch and Tatami stitch.

5. The method according to claim 3, wherein said second predetermined stitch comprises one of a zigzag stitch and a running stitch.

6. An embroidery data processing apparatus for creating sewing data, based on image data representing an embroidery pattern, to be used for forming said embroidery pattern, said apparatus comprising:

an area dividing system, which divides a connected area consisting of a set of connected pixels of said image data into a plurality of divided connected areas;

a stitch type assigning system, which assigns a type of stitch to each of said divided connected areas divided by said area dividing system; and a data creating system, which creates sewing data for each of said divided connected areas, different algorithms being used for creating said sewing data depending on said type of stitch assigned by said stitch type assigning system.

7. The embroidery data processing apparatus according to claim 6, wherein said connected area consists of a set of connected pixels having a predetermined density value.

8. The embroidery data processing apparatus according to claim 6, wherein said area dividing system comprises:

a display, said embroidery pattern being displayed on said display; and an operable member to be operated by an operator to designate positions on said display at which said embroidery pattern is to be divided.

9. The embroidery data processing apparatus according to claim 8, wherein boundary lines are displayed on said display as said operable member is operated and said positions at which said embroidery pattern is to be divided is designated.

10. The embroidery data processing apparatus according to claim 6, wherein if said type of stitch is a first predetermined stitch, said data creating system extracts an outline of said divided connected area, and creates stitch points for filling said outline, said sewing data including data of said stitch points.

11. The embroidery data processing apparatus according to claim 10, wherein said first predetermined stitch comprises one of a satin stitch and Tatami stitch.

12. The embroidery data processing apparatus according to claim 10, wherein if said type of stitch is a second predetermined stitch, said data creating system applies a thinning algorithm to said divided connected area to extract a central line of said divided connected area, and creates stitch points in relation to said central line, said sewing data including data of said stitch points.

13. The embroidery data processing apparatus according to claim 11, wherein said second predetermined stitch comprises one of a zigzag stitch and a running stitch.

* * * * *